United States Patent [19]

Solaja

[11] Patent Number: 4,521,980

[45] Date of Patent: Jun. 11, 1985

[54] GRADING AND SMOOTHING ATTACHMENT FOR A LOADER BUCKET

[76] Inventor: Nikola Solaja, 17 Whittle Pl., Osborne Park, Western Australia, 6017, Australia

[21] Appl. No.: 622,232

[22] Filed: Jun. 19, 1984

[30] Foreign Application Priority Data

Jun. 21, 1983 [AU] Australia ..... PF9919

[51] Int. Cl.[3] ..... E02F 3/96

[52] U.S. Cl. ..... 37/117.5; 37/DIG. 3; 37/DIG. 12; 414/912; 172/701.1

[58] Field of Search ..... 37/DIG. 12, DIG. 3, 37/117.5; 414/912, 724; 172/701.1

[56] References Cited

U.S. PATENT DOCUMENTS

| | | | |
|---|---|---|---|
| 2,566,562 | 9/1951 | Hale | 37/DIG. 3 |
| 2,608,772 | 9/1952 | Laird | 37/DIG. 3 |
| 3,440,744 | 4/1969 | Smith | 37/117.5 |
| 3,469,330 | 9/1969 | Hood et al. | 37/117.5 |
| 3,665,622 | 5/1972 | Lamb | 37/117.5 |
| 3,706,388 | 12/1972 | Westendorf | 37/117.5 X |
| 3,743,358 | 7/1973 | Guest | 37/117.5 X |
| 3,866,342 | 2/1975 | Cooper | 37/DIG. 3 |
| 3,989,404 | 11/1976 | Burton | 37/DIG. 3 |
| 4,189,854 | 2/1980 | Haynes | 37/117.5 |
| 4,242,035 | 12/1980 | Hornstein | 37/117.5 X |
| 4,328,628 | 5/1982 | Thomas | 37/117.5 |
| 4,360,980 | 11/1982 | Jarvis | 37/DIG. 12 |
| 4,411,081 | 10/1983 | King | 37/117.5 |
| 4,463,507 | 8/1984 | Gaub | 37/117.5 |

*Primary Examiner*—Clifford D. Crowder
*Attorney, Agent, or Firm*—Laurence R. Brown

[57] ABSTRACT

A grading and backblading attachment for a loader which attachment comprises an elongated body member, a lateral slot in the body member for engagement with a bucket of a loader, and a blade extending laterally of the body member.

7 Claims, 7 Drawing Figures

GRADING AND SMOOTHING ATTACHMENT FOR A LOADER BUCKET

The present invention relates to a loader attachment. Front end and rear end loaders typically comprise a bucket which is used to scoop up earth, which earth is then transported to another location. Loaders of this type are used where it is desired to level out an area of ground. Once the area of ground has been essentially levelled it is necessary to use a grader to smooth the surface.

The present invention provides an attachment for a loader wherein the loader can additionally perform the function of a grader.

In accordance with one aspect of the present invention there is provided an attachment for a loader which attachment comprises an elongated body member, a lateral slot in the body member for engagement with a bucket of a loader, and a blade extending laterally of the body member.

The present invention will now be described, by way of example, with reference to the accompanying drawings, in which.

Figure 1:
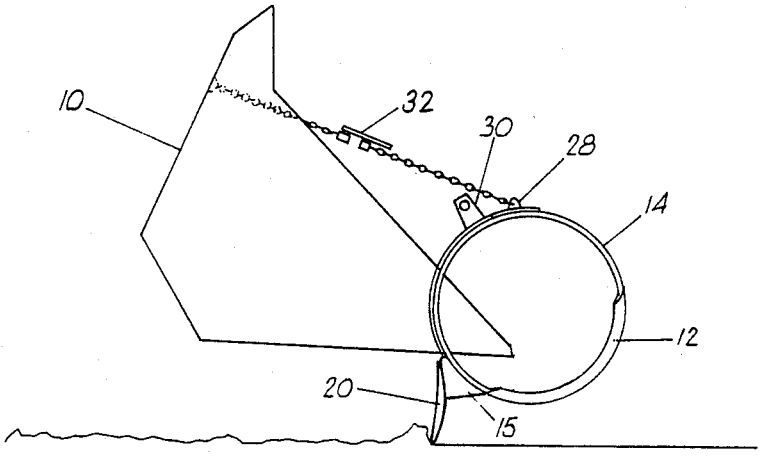
FIG. 1 is a side elevation of a bucket of a loader with an attachment in accordance with the present invention, said bucket being in a first position.
Figure 2:
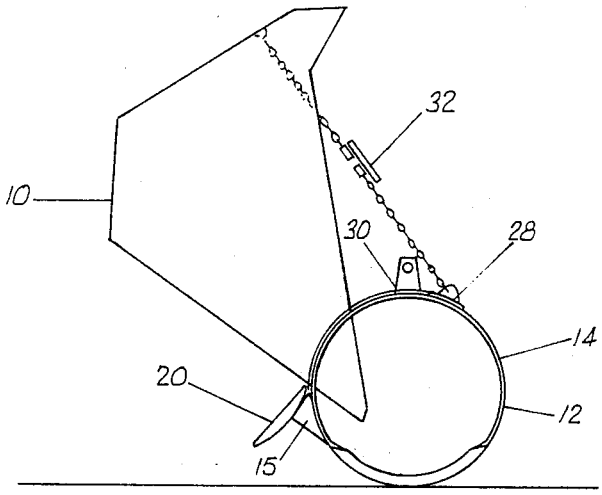
FIG. 2 is a view similar to FIG. 1 with the bucket in a second position.
Figure 3:
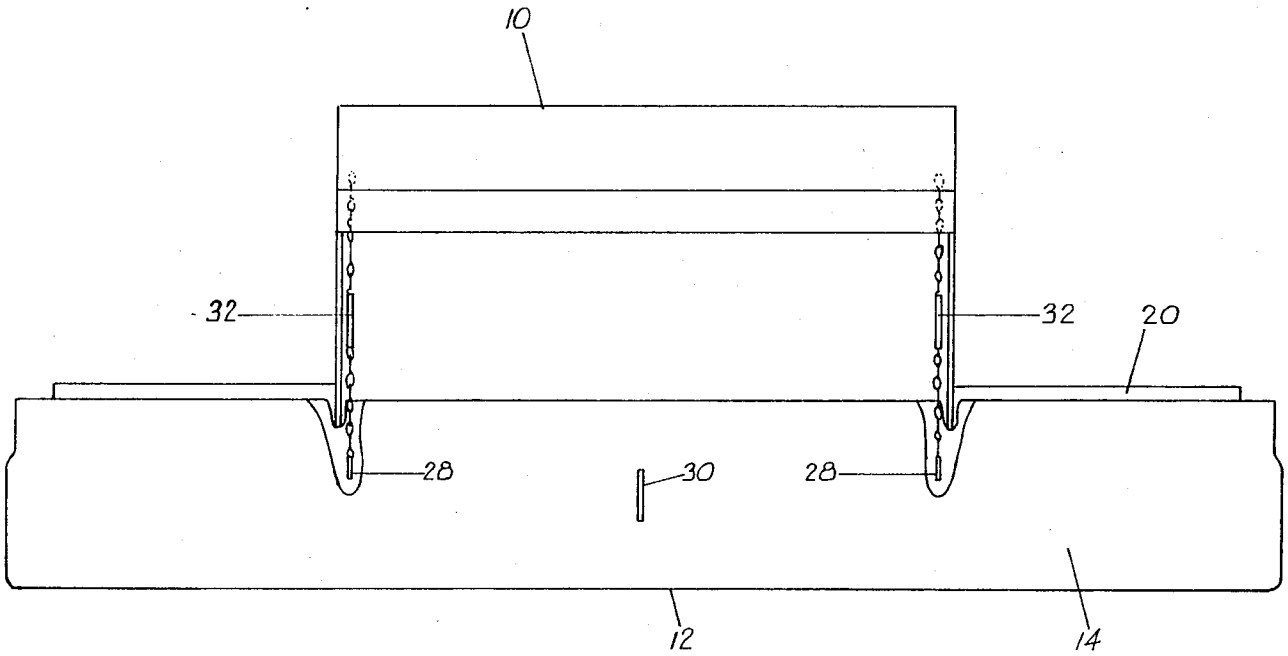
FIG. 3 is a plan view of the assembly of FIG. 1 in the first position of the bucket.

In FIGS. 1 to 3, there is shown a bucket 10 of a front end loader (not shown) having an attachment 12 in accordance with the present invention attached thereto.

Figure 4:
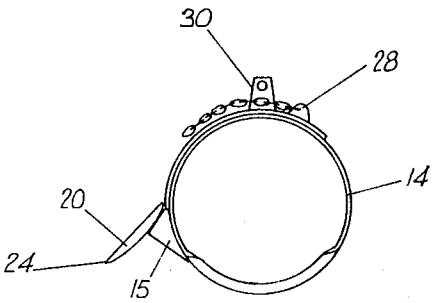
FIG. 4 is an end view of the attachment of FIG. 1.
Figure 5:
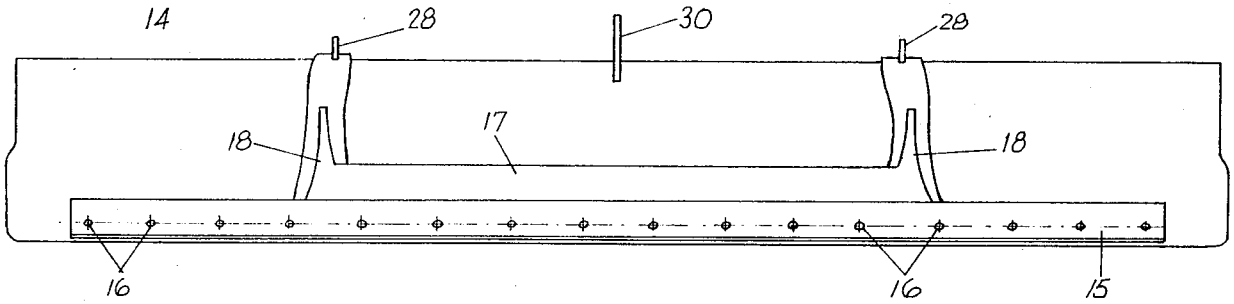
FIG. 5 is a front view of the attachment of FIG. 1 with a blade member removed.

As can be seen in FIGS. 4 to 7, the attachment 12 comprises a cylindrical, hollow body 14 with open ends. As can be seen in FIGS. 4 and 5, the attachment 12 comprises a generally triangular mounting member 15 welded to the outer face of the cylindrically, hollow body 14. The mounting member 15 has an upper, outer face containing a laterally extending row of threaded apertures 16.

Figure 6:
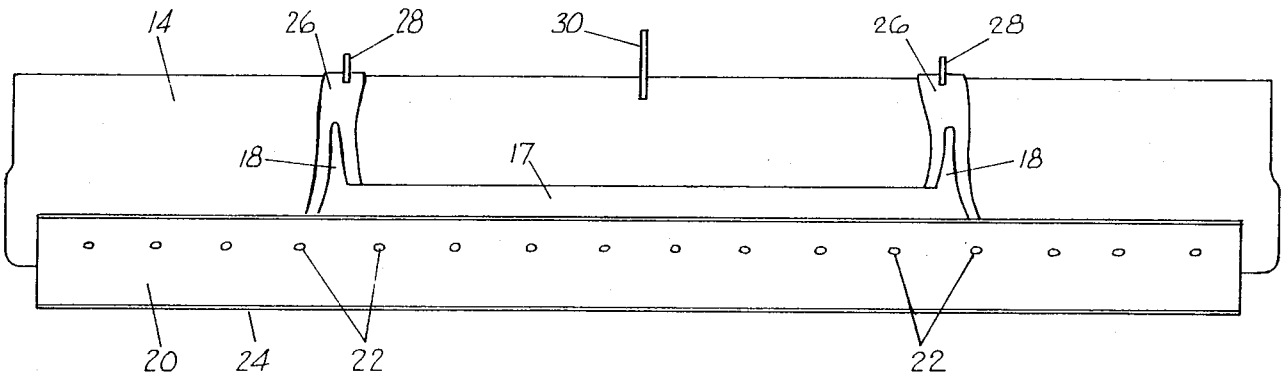
FIG. 6 is a front view of the attachment of FIG. 1 with a blade member attached.
Figure 7:
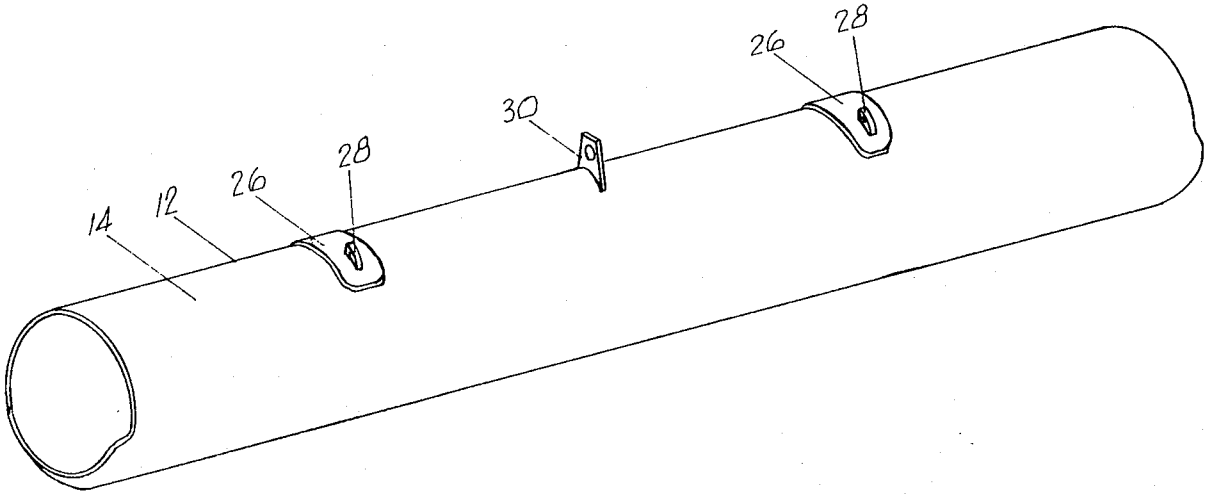
FIG. 7 is a rear perspective view of the attachment.

As can be seen in FIGS. 5 and 6, the hollow body 14 is formed with a lateral slot 17 with upturned ends 18. The slot 17 extends right through the wall of the body 14 and is shaped to fit over the free end of the bucket 10. Further, the slot 17 is located above the mounting member 15.

In use, the mounting member 15 has a blade member 20 mounted thereon. The blade member 20 contains a plurality of holes corresponding with respective apertures 16. The blade member 20 is mounted to the mounting member 15 by means of threaded studs 22 with heads, studs being passed through respective holes in the blade member 20 and threadedly engaged with corresponding apertures 16 as shown in FIG. 6. As can best be seen in FIG. 4, the blade member 20 extends beyond the mounting member 15 and has an outer grading edge 24.

The hollow member 14 has part circular reinforcement members 26 welded to its outer face and extending about the upturned ends 18 of the slot 17.

Adjacent the upper end of the hollow member 14, each reinforcement member 26 is provided with an apertured bracket 28. Further, adjacent the mid-point of the hollow member 14, a larger apertured bracket 30 is provided. The brackets 28 are used to provide mountings for chains as shown in FIGS. 1 and 2 while the bracket 30 is used as an attachment point for a lifting means to lift the hollow member 14. The chains attached to the brackets 28 are connected to similar chains attached to the bucket 10, in use, as shown in FIGS. 1 and 2. The lengths of chains may be connected by load binders 32 or the like. The cylindrical body 14 may be about 4.5 meters long and about 0.5 meters in diameter.

The chains are provided for securing the attachment 12 to the bucket 10.

In use, an attachment member 12 is presented to a bucket 10 so that the slot 17 engages with the free end of bucket 10. Then the attachment member 12 and bucket 10 are secured together such as by chains as described above and as shown in FIGS. 1 to 3.

In this position, the blade 20 faces downwards and is below the bucket 10 as shown in FIGS. 1 and 2.

In a first position, with the bucket lowered, as shown in FIG. 1, the blade 20 is pointed downwardly and is in a grading position. If the front end loader with the bucket 10 is reversed over a tract of ground, the ground is graded and levelled by the outer edge 24 of the blade 20.

In a second position, with the bucket 10 raised as shown in FIG. 2, the blade 20 is pointed upwardly somewhat so that the curved cylindrical surface of the hollow body 14 contacts the ground. In this case, as the front end loader is reversed over a tract of ground, the curved surface smooths ground which has been already levelled by the blade 20. It will be appreciated that the body 14 need not be cylindrical but could have a curved outer face only in the region which is adjacent the ground in the backblading position, shown in FIG. 2.

Thus, the driver of a front end loader can perform two functions with one machine, i.e. the job of a loader and the job of a grader. Also, a grader normally pushes its load in front of it and its wheels leave tracks behind, whereas in the present invention the loader reverses with the attachment 12 trailing in the grading position shown in FIG. 1. This is normally only done when backblading. However, the use of this technique when grading has the advantage that no tracks are left behind. The desired end result is achieved with less effort since no one has to follow up to level the wheel tracks when grading.

By the use of the present invention, the site works can be left clean and level. That is, the present invention enables grading and backblading to be carried out.

Further, the use of a cylindrical body, which may be twice the width of a standard bucket, saves time and money since a wide tract of ground can be treated on each pass. The attachment of the present invention can be easily affixed to a bucket by one man.

Still further, the use of studs to mount the blade member 20 means that a worn blade can be readily replaced even in remote locations.

Whilst the present invention has been described with particular reference to front end loaders it is to be understood that it is equally applicable to rear end loaders. Modifications and variations such as would be apparent to a skilled addressee are deemed within the scope of the present invention.

I claim:

1. An attachment for a loader with a scoop bucket, said attachment positioned to travel ahead of the scoop bucket, wherein the attachment comprises an elongated body member generally in the form of a hollow cylinder, a centrally disposed lateral slot formed within the length of the body member defining opposite ends in the body for mating engagement with the bucket, a blade extending laterally of the elongated body member and projecting outwardly therefrom, and means for securing the attachment to the bucket by mating said bucket in said slot, said blade being disposed relative to the bucket such that when the bucket is orientated in a first position the blade is arranged to engage with the ground and to grade the ground upon movement of the loader and when the bucket is orientated in a second position the body member is arranged to engage with the ground and to smooth the ground upon movement of the loader.

2. An attachment according to claim 1, in which the ends of the lateral slot are shaped to fit over a free end of the bucket.

3. An attachment according to claim 1, in which the means for securing the attachment to the bucket comprises chains.

4. An attachment according to claim 1, in which the blade is removably attached to the body member.

5. An attachment according to claim 4, in which the blade is attached to the body member by means of studs threadedly engaged with apertures of the body member.

6. An attachment according to claim 4, in which the body member has an apertured mounting member attached to an outer face thereon disposed to receive the blade by means of studs threadedly engaged with apertures in the mounting member.

7. An attachment according to claim 1 positioned to move toward the loader for grading and smoothing.

* * * * *